United States Patent [19]

Hertel et al.

[11] 4,224,027

[45] Sep. 23, 1980

[54] PROCESS FOR THE PRODUCTION OF WATER-INSOLUBLE AZO DYESTUFFS ON THE FIBER WITH POLYPHOSPHATE

[75] Inventors: Hasso Hertel, Mühlheim am Main; Adolf Trampusch, Frankfurt am Main, both of Fed. Rep. of Germany

[73] Assignee: Hoechst Aktiengesellschaft, Fed. Rep. of Germany

[21] Appl. No.: 24,429

[22] Filed: Mar. 26, 1979

Related U.S. Application Data

[63] Continuation of Ser. No. 882,222, Feb. 28, 1978, abandoned.

[30] Foreign Application Priority Data

Mar. 5, 1977 [DE] Fed. Rep. of Germany ..... 2709623

[51] Int. Cl.[2] ..... C09B 27/80; D06P 3/12

[52] U.S. Cl. ..... 8/666

[58] Field of Search ..... 8/44, 46, 42 R, 82, 8/41 R

[56] References Cited

U.S. PATENT DOCUMENTS

| | | | |
|---|---|---|---|
| 3,071,428 | 1/1963 | Gross et al. | 8/42 R |
| 4,035,144 | 7/1977 | Hertel | 8/44 |
| 4,082,503 | 4/1978 | Hertel | 8/44 |

*Primary Examiner*—A. Lionel Clingman

*Attorney, Agent, or Firm*—Connolly and Hutz

[57] ABSTRACT

By the present invention there has been found an improved process for the production of water-insoluble azo dyestuffs on the fiber according to the methods of the ice color dyeing, in which the fiber material is at first impregnated with a coupling component in an alkaline medium and thereafter developed by treating it with a developing bath which contains the diazonium compound; the improvement is characterized in that the developing bath contains an alkali metal-tri- or -tetrapolyphosphate and the pH value of the developing bath is greater than 4.5 prior to the coupling and smaller than 9 after the same. As compared with known processes, the novel process has the advantage that in this case there are not used any heavy metal salts, such as chromium and zinc salts, which have an adverse effect on the waste waters, and that besides there are no precipitates of zinc phosphate even in the case of zinc ions being present in the dye baths. The dyeings obtained with the novel process are marked by a good color yield, a good evenness and favorable fastness properties.

2 Claims, No Drawings

PROCESS FOR THE PRODUCTION OF WATER-INSOLUBLE AZO DYESTUFFS ON THE FIBER WITH POLYPHOSPHATE

This application is a continuation of application Ser. No. 882,222 filed Feb. 28, 1978 now abandoned.

The present invention provides an improved process for the production of water-insoluble azo dyestuffs on the fiber according to the methods of the ice-color technique.

As has been already known, the production of water-insoluble azo dyestuffs on the fiber according to the ice-color technique is effected by reacting a diazonium compound with a coupling component, with no water-solubilizing groups, such as sulfo or carboxy groups, being contained in the diazo and coupling components. The process is carried out in a way that the coupling component is first applied onto the textile material from a caustic alkaline bath, and the textile goods thus treated are then placed into another bath containing the diazonium compound, in which the dyestuff is formed. In order to yield dyeings of a high tinctorial strength and a good fastness to rubbing, the azo coupling has to be performed in a slightly acid to slightly alkaline range, depending on the kind of component used.

Therefore, the baths containing the diazonium compound must contain agents which bind the alkali adherent to the textile material and which maintain the desired pH range by buffering. Besides showing a high buffering capacity, they are required to have a good compatibility with the components used. In practice there are used, for example, acetic acid/sodium acetate, mono-/disodium phosphate, chromium acetate, zinc sulfate, and aluminum sulfate (cf. Ullmanns Enzylkopädie der technischen Chemie, 3rd edition, vol. 7, page 23; HOECHST AG, Naphtol AS-Anwendungsvorschriften (1971), chapter 1.4).

Generally the dyestuff formation is effected in a slightly acid medium at a pH value of from about 4 to 5.5. However, dyestuff components having a low coupling energy require a nearly neutral coupling medium in order to give good results. For this purpose, of the above-mentioned substances there are suitable mono- and disodium phosphate, zinc sulfate and chromium acetate. However, certain drawbacks are inherent in each of these products: Chromium acetate and zinc sulfate are undesired as heavy metals in the waste waters for ecological reasons. The buffer mixture of mono- and disodium phosphate can only be used with aromatic amines which have been previously diazotized, but not with the dyeing salts present as diazonium tetrachlorozincate, as in this process insoluble zinc phosphate is formed.

The present invention provides an improved process for the production of metal-free water-insoluble azo dyestuffs on the fiber according to the ice-color technique, in which the coupling component is at first applied from an alkaline bath, respectively, by way of an alkaline liquor, onto the textile material, preferably cellulose or cellulose-containing textile material, and said textile goods are then treated with a developing bath, respectively, with a developing liquor, containing the diazonium compound. This improvement comprises using for the development of the dyeing goods a developing bath which contains an alkali metal-tri- or -tetrapolyphosphate and whose pH value prior to the dyestuff coupling is greater than 4.5, preferably in the range of from 5.2 to 7.5, especially 5.5 to 7.0, and after the dyestuff coupling is smaller than 9, preferably in the range of from 7.8 to 6, especially 7.5 to 6.5.

In this context as well as in the following passages, the term "bath" includes the term "liquor" when reference is made to bottoming (impregnation) baths and developing baths.

The alkali-tri- or -tetrapolyphosphates used in accordance with the invention are suitable in a very advantageous manner as alkali-binding buffers for the dyeing in the ice-color dyeing when used in the slightly alkaline to slightly acid medium, especially in the presence of acid substances, for example, of the acids in the diazonium salt solution used for the developing bath, in the neutral to slightly acid medium. The alkali-tri- and -tetrapolyphosphates are well compatible with the diazonium salt solutions and are less objectionable from the ecological point of view than the two heavy-metal salts mentioned above. With zinc ions they do not form any precipitates, even in the presence of orthophosphate ions, so that they may also be used for diazonium-tetrachloro-zincate dyeing salts.

The alkali polyphosphates used according to the invention are added to the diazonium solutions as such or as a solution with water. The pH value of the developing bath ready for use is to be preferably in the range of from about 5.5 to 7.0, preferably from 6.0 to 6.5. In cases where for adjusting this pH value in the developing bath the acid present in the diazo solution is insufficient or completely missing, for example when using solid diazonium salts, acid agents are to be added. As such, there may be mentioned strong, moderately strong or weak inorganic or organic acids, the term "acid" also comprising acid salts. There may be mentioned, for example, hydrochloric acid, sulfuric acid, phosphoric acids, acetic acid, citric acid, tartaric acid, succinic acid, as well as monosodium-orthophosphate.

Since with the impregnated textile material more alkali is introduced into the developing bath than acid is formed in the azo coupling, the pH value increases in the course of the dyestuff formation. However, the pH value is to be less than 9, preferably between about 7.5 and 6.5 upon completion of the coupling. This is effected according to the invention by the alkali-tri- and -tetrapolyphosphates used. In those cases where extremely high amounts of alkali are introduced into the developing bath by way of the bottoming bath, and the amount of alkali-tri- or -tetrapolyphosphate as buffer might not be sufficient, the pH range indicated may optionally be maintained during the dyeing process by adding acid agents, for example those mentioned above, to the developing bath; however, this is not necessary when the bottoming process is carried out in the usual, common way.

As in the preparation of the azo dyestuffs on the fiber according to the pad-dyeing process more alkali is introduced together with the fiber material into the developing bath than is the case with the batchwise exhaustion method, it may also be advantageous to use for the pad-dyeing method a ready-for-use developing liquor whose pH value of from 4.5 to 6.0 is somewhat lower.

If an additional acid is used in preparing the developing baths, it is recommended to add said acid first and thereafter the alkali polyphosphate.

Alkali-tri- and -tetrapolyphosphates may be used in the slightly alkaline to slightly acid range according to the invention as alkali-binding buffers for all diazonium salt solutions that are common in the ice-color dyeing.

Aromatic amines which are suitable as diazo components in the ice-color techniques and which are used therein have been described in literature in numerous cases, for example, chloroanilines, nitranilines, anisidines, chlorotoluidines, chloroanisidines, chloronitranilines, trifluoromethylanilines, aniline-, toluidine- and anisidine-sulfonic acid-mono- and -dialkylamides with lower alkyl groups, toluidine- and anisidine-carboxylic acid amides, p-amidodiphenylamine and the methoxy derivatives thereof, acylaminoanilines with an acylamino radical of an aliphatic or aromatic carboxylic acid, of these, in particular benzoylaminoanilines which may be substituted by halogen atoms, for example chlorine, lower alkyl and/or lower alkoxy groups, aminoazobenzenes which may be substituted by halogen, such as chlorine, lower alkyl, lower akoxy and/or nitro and/or by aminophenylamino radicals, as well as o-tolidine and o-dianisidine (by the above term "lower" there are to be understood radicals which contain an alkyl radical of from 1 to 5 carbon atoms). The aromatic amino components are used in the process of the invention in the form of their diazonium salt solutions.

Of these components, there is to be mentioned in particular the use of the diazonium compounds of an anisidine-carboxylic acid amide compound, of a p-aminodiphenylamine, of a 3- or 4-benzoylaminoaniline or of a 4,4'-diaminodiphenyl compound in the process of the invention. The use of 4-chloro-2-amino-anisol, 5-nitro-2-amino-toluene, 5-nitro-2-amino-anisol, 2-aminoanisol-4-sulfonic acid-diethylamide, 2-aminoanisol-4-carboxylic acid amide, 4-amino-2',3-dimethylazobenzene, 4-benzoylamino-2,5-diethoxy-aniline, 2-amino-5-benzoylamino-4-methyl-anisol, 4-chloro-2-amino-5-benzoylamino-toluene, 4-amino-diphenylamine, 4'-amino-4-methoxy-diphenylamine and 4-amino-3-methoxy-diphenylamine, as well as the bisdiazonium salt solutions of o-dianisidine, 4,4'-diamino-diphenylamine and 4'-(4''-aminophenyl-amino)-4-amino-6-ethoxy-3-methyl-azobenzene (cf. Colour Index, 3rd edition (1971), Nos. 37 000–37 275) may be mentioned in particular for the process of the invention.

The diazonium salt solutions may be obtained by the diazotization of the aromatic amines or by the dissolution of diazonium salt compositions. Their preparation is carried out according to known methods. Information on this subject may be found, for example, in K. Holzach, Die Diazoverbindungen, Stuttgart (1947), or in Ullmanns Enzyklopädie der technischen Chemie, 3rd edition, vol. 5, pages 791 et seq. (and further literature indicated therein).

As coupling components there may be mentioned for the process of the invention those compounds that are capable of coupling, i.e. compounds which contain a hydroxy group effecting the coupling, and are commonly used in the ice-color technique (cf. Colour Index, 3rd edition (1971), C.I. Nos. 37 505–37 625).

In the process according to the invention there is preferably used as coupling component a 2-hydroxynaphthalene-3-carboxylic acid-phenylamide compound (for example having the C.I. Nos. 37 505 to 37 569), a 2-hydroxycarbazole-1-carboxylic acid-phenylamide compound (for example having the C.I. No. 37 600), a 2-hydroxy-dibenzofuran-3-carboxylic acid-phenylamide compound (for example having the C.I. No. 37 605) or a 2-hydroxybenzocarbazole-3-carboxylic acid-phenylamide compound (for example having the C.I. Nos. 37 590 to 37 595).

The alkali-tri- and -tetrapolyphosphates are used in a particularly advantageous manner in those dyeings in which diazo or coupling components are employed that are slow to couple, so that, in order to obtain an optimum dyeing result, these dyeings must be carried out near the neutral point. Components of this kind are in the series of the diazo components the diazonium salts of aminodiphenylene, aminophenylamines and benzoylaminoanilines as well as of some amino-benzene-carboxylic acid amides and aminobenzene-sulfonic acid amides, and in the series of the coupling components hydroxy-diphenylene oxidecarboxylic acid anilides and some hydroxy-carbazole-carboxylic acid anilides and hydroxy-benzocarbazole-carboxylic acid anilides.

An especially suitable alkali-tripolyphosphate is sodium-tripolyphosphate ($Na_5P_3O_{10}$) which is prepared on an industrial scale as the only polyphosphate being free from other oligomers. It shows a particularly advantageous effect in a buffer system which also contains sodium bicarbonate and/or sodium dihydrogenophosphate.

The alkali-tri- and -tetrapolyphosphates may be used according to the invention in a high, medium and low good-to-liquor ratio as well as in the batchwise exhaustion and the pad-dyeing processes. The amounts used depend on the amount of alkali to be buffered and are in the range of from about 25 to 250 molar percent, calculated on the diazonium salt used.

The dyeings prepared according to the process of the invention are distinguished by good color yields, good evenness and favorable fastness properties.

The following Examples serve to illustrate the invention, the parts being parts by weight.

EXAMPLE 1

9 Parts of 2-hydroxynaphthalene-3-carboxylic acid-(4'-chlorophenyl-1')-amide are stirred into a paste with 10 parts of ethanol and are dissolved by adding 5.5 parts of an aqueous 32% sodium hydroxide solution as well as 14 parts of water of 40° C. Subsequently 4.5 parts of a 33% formaldehyde solution are also introduced. After 10 minutes this standard solution is combined with a solution of 44 parts of an aqueous 32% sodium hydroxide solution, 180 parts of sodium chloride and 18 parts of a commercial fatty acid-protein degradation product-condensate in 6000 parts of soft water of 35° C. A cross-wound bobbin with 600 parts of cotton yarn which has been boiled in an alkaline bath containing a surfactant and a sequestering agent, in order to remove undesired non-cellulose substances, is treated for 30 minutes with the above bath in a small cheese dyeing machine.

The bath is let off, and the impregnated bobbin is rinsed for 10 minutes with a solution of 300 parts of sodium chloride and 4 parts of an aqueous 32% sodium hydroxide solution in 6000 parts of water. After discharging the rinsing bath, a developing liquor having a temperature of about 20° C. is circulated through the cross-wound bobbin; this liquor contains in 6000 parts of water 16.5 parts of 2-benzoylamino-4-methoxy-1-methyl-benzene-5-diazonium-tetrachlorozincate, 18 parts of monosodium-phosphate dihydrate, 18 parts of pentasodium-tripolyphosphate and 2 parts of an octadecyl alcohol-polyglycolether. Prior to coupling, the pH value of the developing bath is 6.3 and following the coupling it is 7.2. After about 30 minutes the developing liquor is let off, the cross-wound bobbin is rinsed with an acid medium as usual, then clear-rinsed with a cold bath, then it is washed first at 60° C. and thereafter at 100° C. and subsequently rinsed with warm and cold water and finally dried.

A violet dyeing is obtained in a good color yield which shows good fastness properties and a regular dyeing outside and inside the bobbin.

EXAMPLE 2

If the process is carried out according to the specifications given in Example 1, however, while using instead of the bath described therein the following bottoming and developing baths, a bordo dyeing is obtained in a good color yield, which possesses good fastness properties and shows a regular dyeing throughout the bobbin. The pH value of the developing bath prior to the coupling is 6.1, and after the coupling it is 6.7.

Bottoming bath

42 Parts of a solution of 40 parts of 2-hydroxynaphthalene-3-carboxylic acid-(naphthyl-1')-amide in 15 parts of ethylene glycol, 25 parts of diethylene glycol, 15.7 parts of an aqueous 33% sodium hydroxide solution and 4.6 parts of water (this solution is fast to storage) are introduced, while stirring, into a solution of 33 parts of an aqueous 33% sodium hydroxide solution, 120 parts of sodium chloride and 18 parts of a fatty acid-protein degradation product-condensate in 6000 parts of water of 35° C.

Developing bath

66 Parts of a dyeing composition of 4-chloro-3-benzoylamino-1-methyl-benzene-6-diazonium-tetrachloroazincate adjusted to a content of 30% by weight (referred to a molecular weight of 260.5) with sodium sulfate, are dissolved, together with 30 parts of monosodium-phosphate-dihydrate, 18 parts of pentasodium-tripolyphosphate and 2 parts of an octadecyl alcohol-polyglycolether, in 6000 parts of water of 20° C.

EXAMPLE 3

If the process is carried out according to the specifications given in Example 1, while using the baths described below, a blue dyeing is obtained in a good color yield and with good fastness properties which is completely uniform. The pH value of the developing bath is 6.3 prior to the coupling, and 7.2 after the same.

Bottoming bath

16 Parts of 2-hydroxynaphthalene-3-carboxylic acid-(4'-chloro-2'-methyl-phenyl-1')-amide are dissolved in 27 parts of ethanol, 32 parts of water of 40° C., 11 parts of an aqueous 33% sodium hydroxide solution and 16 parts of 30% formaldehyde and are then introduced by stirring into a mixture of 38 parts of an aqueous 33% sodium hydroxide solution, 120 parts of sodium chloride and 18 parts of a fatty acid-protein degradation product-condensate in 6000 parts of water of 35° C.

Developing bath

58 Parts of a dyeing composition with a content of 36% by weight (referred to a molecular weight of 300) of 2-benzoylamino-1,4-diethoxy-benzene-5-diazonium-tetrachlorozincate (the residual part is essentially sodium sulfate) are dissolved, together with 18 parts of monosodiumphosphate-dihydrate, 18 parts of pentasodium-tripolyphosphate and 2 parts of an octadecyl alcohol-polyglycolether, in 6000 parts of water of 20° C.

EXAMPLE 4

A dyeing identical with that of Example 3 is obtained, if there are used 30 parts of pentasodium-tripolyphosphate and 6.6 parts of citric acid-monohydrate in the developing bath instead of 18 parts of monosodium-phosphate-dihydrate and 18 parts of pentasodium-tripolyphosphate. The pH value of the developing bath is 5.8 prior to the coupling, and 6.8 after the same.

EXAMPLE 5

A mixture of 3.4 parts of ethanol, 4 parts of water, 1.4 parts of an aqueous 32% sodium hydroxide solution and 2 parts of 33% formaldehyde is poured over 2 parts of 2-hydroxynaphthalene-3-carboxylic acid-(4'-chloro-2'-phenyl-1')-amide which is dissolved therein by stirring. After 10 minutes this solution is introduced into 1000 parts of water containing 8.1 parts of an aqueous 32% sodium hydroxide solution and 2 parts of a fatty acid protein degradation product-condensate. 50 Parts of bleached, boiled and wetted-out cotton yarn are placed into this solution and are treated for 30 minutes, while being moved well in the bath; thereafter the goods are taken out, rinsed in a solution of 30 parts of sodium chloride and 1.3 parts of an aqueous 32% sodium hydroxide solution in 1000 parts of water and then introduced into a bath which is prepared as follows: 2.2 Parts of 5-amino-2-benzoylamino-1,4-dimethoxy-benzene are stirred with 45 parts of water, then 2.8 parts of an aqueous 32% hydrochloric acid are added, and thereafter the solution is diazotized at about 15° C. with 0.58 parts of sodium nitrite in a concentrated aqueous solution.

The excess acid is eliminated by adding 2.5 parts of sodium-tripolyphosphate; after having added 1.2 parts of a polyethylene-glycolether, the mixture is filled up with water to 1000 parts. In this bath the textile material introduced is treated for 30 minutes, is taken out, rinsed as usual, soaped and dried. A blue dyeing is obtained in a good color yield, which shows good fastness properties.

The pH value of the developing bath is 6.0 prior to the coupling and 7.4 after the same.

EXAMPLE 6

If in Example 5 there are used 3.0 g of potassium-tripolyphosphate instead of 2.5 g of sodium-polyphosphate, a dyeing is obtained which shows the same color shade as well as the same fastness properties. The pH value of the developing bath is 6.0 prior to the coupling and 7.4 after the same.

EXAMPLE 7

In order to prepare a blue dyeing on cotton, cotton fabric is padded with a solution of 12.5 parts of 2-hydroxy-naphthalene-3-carboxylic acid-phenylamide (Colour Index No. 37 505), 17 parts of an aqueous 32% sodium hydroxide solution and 5 parts of a commercial dyeing and levelling auxiliary agent on the basis of a fatty acid-protein degradation product-condensate in 1000 parts of water at a liquor pick-up of 80% by weight, calculated on the fabric. The goods are dried and then padded over with another dye liquor (developing bath) of room temperature in a second padder (the liquor pick-up being also 800 g per kg of fabric). This second padding liquor is prepared as follows: 17 parts of 5-amino-2-benzoylamino-1,5-diethoxy-benzene are stirred together with 340 parts of water. After having added 20 parts of an aqueous 32% hydrochloric acid and a small amount of ice, the mixture is diazotized at a temperature not exceeding 15° C. with 3.5 parts of sodium nitrate in a concentrated aqueous solution. 15 Parts of sodium tripolyphosphate, 18 parts of monosodiumphosphate-dihydrate and 2 parts of polyethleneglycolether are added, and the solution is filled up with water to 1000 parts.

The pH value of the developing bath is 5.3 prior to the coupling and 6.8 after the same.

After an air passage of about 1 minute, a hot water passage follows. Subsequently the goods are washed as usual, soaped, rinsed and dried.

EXAMPLE 8

7 Parts of 2-hydroxy-naphthalene-3-carboxylic acid-(4'-chloro-2',5'-dimethoxyphenyl-1')-amide are stirred into a paste with 8.5 parts of ethanol. 3.8 Parts of an aqueous 32% sodium hydroxide solution are added. Subsequently 14 parts of water of 40° C. are introduced while stirring, in which process the naphthol is dissolved. 5 Parts of 33% formaldehyde are added. After about 10 minutes this standard solution is divided into two portions.

A solution of 960 parts of water, 6.3 parts of 32% sodium hydroxide solution and 5 parts of a fatty acid-protein degradation product-condensate are introduced into the trough of a jig. One portion of the above-described standard solution is introduced with stirring. Thereafter 330 parts of cotton fabric are treated with this bath in the jig for about 40 minutes, the other portion of the standard solution being added to the jig bath following the first passage of the fabric.

Subsequently the bath is let off, and the trough is filled with the developing bath which is prepared as follows:

6.7 Parts of a mixture of 90 parts of 4-chloro-2-amino-toluenechlorohydrate and 10 parts of sodium chloride are stirred into a paste with a mixture of 1.4 parts of stearyl alcohol-polyglycolether and 67 parts of cold water. 7.8 Parts of an aqueous 32% hydrochloric acid and thereafter 100 parts of cold water are added. Subsequently 2.7 parts of sodium nitrate in a concentrated aqueous solution are introduced below the surface, while stirring thoroughly. After 15 minutes, 15 parts of sodium-tripolyphosphate and 1 part of succinic acid are added. The bath is filled up to 1000 parts with cold water.

The impregnated fabric is treated in this developing bath for about 30 minutes, developing the dyeing, and is thereafter rinsed as usual, soaped, rinsed again and dried. A subdued red dyeing is obtained which has good fastness properties.

The pH value of the developing bath is 6.1 prior to the coupling and 6.9 after the same.

EXAMPLE 9

In order to obtain a brown dyeing with good fastness properties, the process is carried out as described in Example 8, however, while using another standard solution for the preparation of the bottoming bath. Said solution is prepared as follows: A mixture of 4.5 parts of ethanol, 42 parts of water of 40° C. and 7 parts of an aqueous 32% sodium hydroxide solution is poured over 10.5 parts of a commercial 50% composition of 2-hydroxycarbazole-1-carboxylic acid-(4'-chloro-phenyl-1')-amide (the remainder being usual organic and inorganic diluents as, for example, sodium sulfate), said constituents being dissolved by stirring.

EXAMPLE 10

A dyeing which shows practically the same color shade as that of Example 9, however, with even a somewhat improved fastness, level, is obtained if 4-chloro-2-amino-toluene-chlorohydrate is replaced by 6-chloro-2-amino-toluene-chlorohydrate in the preparation of the developing bath. The pH value of the developing bath is 6.4 prior to the coupling and 7.8 after the same.

EXAMPLE 11

If in Example 8 the 15 parts of sodium-tripolyphosphate are replaced by 20 parts of sodium-tetrapolyphosphate, a dyeing is obtained which has the same color shade and the same fastness properties as that of Example 8. The pH value of the developing bath is 6.1 prior to the coupling and 6.9 after the same.

EXAMPLE 12

For the preparation of a red dyeing on cotton yarn, a wetted-out cross-wound bobbin with 500 parts of cotton yarn is treated in a dyeing apparatus first with 5000 parts of a dye bath containing 12.5 parts of 2-hydroxynaphthalene-3-carboxylic acid-(5'-chloro-2'-methoxyphenyl-1')-amide, 48 parts of an aqueous 32% sodium hydroxide solution, 100 parts of sodium chloride, 6 parts of 33% formaldehyde and 15 parts of a common protective colloid.

After 30 minutes this bath is pumped off. The impregnated yarn is subjected to an intermediate rinsing process for 8 minutes using a solution of 150 parts of sodium chloride and 5 parts of an aqueous 33% solution hydroxide solution in 5000 parts by volume of water. After this bath has been pumped off, the crosswound bobbin is treated for 8 minutes with a dye bath which is prepared as follows: 15 Parts of 2-amino-1-methyl-2-sulfonic acid-dimethylamide are stirred with 60 parts of water, and after adding 25.5 parts of an aqueous 32% hydrochloric acid and 75 parts of ice, the mixture is diazotized with 5 parts of sodium nitrate in a concentrated aqueous solution at 10° C. By introducing 25 parts of sodium-tripolyphosphate the excess acid is eliminated; subsequently 7.5 parts of a polyethyleneglycolether are added, and the mixture is made up to 5000 parts with water.

The pH value of the developing bath is 6.0 prior to the coupling and 7.1 after the same.

Following the developing process the goods are rinsed as usual, soaped first at 60° C., thereafter at 100° C., clear-rinsed and dried.

EXAMPLE 13

A mixture of 5 parts of ethanol, 4 parts of water, 2 parts of an aqueous 32% sodium hydroxide solution and 2 parts of 33% formaldehyde is poured over 2.8 parts of 2-hydroxynaphthalene-3-carboxylic acid-naphthyl-1'-amide which is dissolved therein by stirring. After 10 minutes this solution is introduced into 1000 parts of water containing 8.5 parts of an aqueous 32% sodium hydroxide solution and 2 parts of a fatty acid-protein degradation product-condensate. 50 Parts of bleached, boiled and wetted-out cotton yarn are placed into this solution and are treated for 30 parts, while being moved well in the bath. Then the goods are taken out, rinsed in a solution of 30 parts of sodium chloride and 1.3 parts of an aqueous 32% sodium hydroxide solution in 1000 parts of water and introduced into a developing bath which is prepared as follows: 1 Part of 4,4'-diamino-3,3'- dimethoxy-diphenyl is dissolved with 20 parts of boiling water and 3.3 parts of an aqueous 32% hydrochloric acid. Upon cooling and after adding 20 parts of ice, the mixture is diazotized with 0.58 part of sodium nitrate in a concentrated aqueous solution. The excess acid is eliminated by the addition of 5 parts of sodium-tripolyphosphate; 1.5 parts of a polyethylene-glycolether are added, and the whole mixture is filled up to 1000 parts with water.

In this developing bath the textile material introduced is treated for 30 minutes, is taken out, rinsed as usual, soaped and dried.

The pH value of the developing bath is 6.4 prior to the coupling and 7.4 following the same.

A blue dyeing is obtained in a good color yield and with good fastness properties.

EXAMPLES 14 to 22

If the process is carried out as has been described in Example 5, however, while using instead of the 5-amino-2-benzoylamino-1,4-dimethoxybenzene employed therein the equivalent amount of one of the following amines, fast dyeings are also obtained in the color shades indicated:

| Example | Diazo component | Color shade |
|---|---|---|
| 14 | 4-chloro-5-amino-2-benzoylamino-anisole | currant red |
| 15 | 1,3-dimethoxy-4-amino-6-benzoylamino-benzene | violet |
| 16 | 1,3-dimethyl-4-amino-6-benzoylamino-benzene | red |
| 17 | 5-chloro-2-amino-toluene | red |
| 18 | 4-chloro-2-amino-anisole | red |
| 19 | 2-amino-anisole-4-sulfonic acid-diethyl-amide | red |
| 20 | 4-amino-2',3-dimethyl-azobenzene | garnet |
| 21 | 4-amino-2,3'-dimethyl-azobenzene | garnet |
| 22 | 3-chloroaniline | orange |

EXAMPLES 23 to 27

If the process is carried out as has been described in Example 1, however, while using, instead of the 2-benzoylamino-4-methoxy-1-methyl-benzene-5-diazonium-tetrachlorozincate employed therein, an equivalent amount of one of the following diazonium salts, fast dyeings are also obtained in the indicated color shades:

| Example | Diazo component | Color shade |
|---|---|---|
| 23 | 4-chloro-2-benzoylamino-1-methoxy-benzene-5-diazonium-tetrachlorozincate | violet |
| 24 | 1-chloro-benzene-2-diazonium-tetra-chloro-zincate | red |
| 25 | 6-chloro-1-methyl-benzene-2-diazonium-tetrachlorozincate | red |
| 26 | 1-methoxy-4-sulfon-(N-n-butyl)-amido-benzene-2-diazonium-tetrachlorozincate | red |
| 27 | 1-methoxy-4-carbon-(N-phenyl)-amido-benzene-2-diazonium-tetrachlorozincate | red |

EXAMPLES 28 to 32

If the process is carried out as has been described in Example 7, however, while using, instead of 12.5 parts of 2-hydroxy-naphthalene-3-carboxylic acid-phenylamide, the equimolar amount of one of the coupling components specified below, fast dyeings are also obtained in similar color shades:

| Example | Coupling component |
|---|---|
| 28 | 2-hydroxy-naphthalene-3-carboxylic acid-(2'-methyl-phenyl)-amide |
| 29 | 2-hydroxy-naphthalene-3-carboxylic acid-(2'-methoxy-phenyl)-amide |
| 30 | 2-hydroxy-naphthalene-3-carboxylic acid-(4'-methoxy-phenyl)-amide |
| 31 | 2-hydroxy-naphthalene-3-carboxylic acid-(4'-methoxy-2'-methyl-phenyl)-amide |
| 32 | 2-hydroxy-naphthalene-3-carboxylic acid-(4'-ethoxy-phenyl)-amide |

EXAMPLES 33 to 35

If the process is carried out as has been indicated in Example 12, however, while using instead of 12.5 parts of 2-hydroxy-naphthalene-3-carboxylic acid-(5'-chloro-2'-methoxyphenyl-1')-amide one of the following coupling components in the amount specified, dyeings are obtained in red color shades which have good fastness properties:

| Example | Amount | Coupling component |
|---|---|---|
| 33 | 10 parts | 2-hydroxy-naphthalene-3-carboxylic acid-(4'-chloro-5'-methyl-2'-methoxy-phenyl)-amide |
| 34 | 9 parts | 2-hydroxy-naphthalene-3-carboxylic acid-(naphthyl-2')-amide |
| 35 | 15 parts | 2-hydroxy-naphthalene-3-carboxylic acid-(5'-chloro-2',4'-dimethoxyphenyl-1')-amide |

EXAMPLE 36

The process is carried out as has been indicated in Example 8, however, while using instead of 4-chloro-2-aminotoluene-hydrochloride an equivalent amount of 2-amino-anisole-4-carboxylic acid amide-hydrochloride. A brilliant red dyeing is obtained with good fastness properties.

EXAMPLE 37

If the process is carried out as has been described in Example 1, however, while using the baths specified below, a black dyeing is obtained in a good color yield, which possesses good fastness properties and is completely uniform. The pH value of the developing bath is 6.3 prior to the coupling and 7.4 following the same.

Bottoming bath

16 Parts of 2-hydroxy-benzocarbazole-3-carboxylic acid-(4'-methoxy-phenyl-1')-amide are dissolved in 27 parts of ethanol, 32 parts of water of 50° C., 5.5 parts of 33% sodium hydroxide solution and 8 parts of 30% formaldehyde; this solution is introduced by stirring into a mixture of 63 parts of an aqueous 33% sodium hydroxide solution and 24 parts of a fatty acid-protein degradation product-condensate in 6000 parts of water of 35° C.

Developing bath

58 Parts of a dyeing composition with a content of 20% by weight (referred to a molecular weight of 168) of 5-nitro-1-methoxy-benzene-2-diazonium-naphthalene-1',5'-disulfonate (the residual part is essentially sodium sulfate) are dissolved, together with 18 parts of monosodiumphosphate-dihydrate, 18 parts of pentasodium-tripolyphosphate and 2 parts of an octadecyl alcohol-polyglycolether, in 6000 parts of water of 20° C.

EXAMPLE 38

Largely identical dyeing are obtained, if the coupling component in Example 37 is replaced by 2-hydroxybenzocarbazole-3-carboxylic acid-(4'-methoxy-2'-methyl-phenyl-1')-amide and/or the diazo component is replaced by an equivalent amount of 5-nitro-1-methylbenzene-2-diazonium-tetrafluoborate.

EXAMPLE 39

If the process is carried out as has been indicated in Example 1, however, while using the baths specified below, a brown dyeing is obtained in a good color yield, which has good fastness properties and is completely uniform. The pH value of the developing bath is 6.3 prior to the coupling and 7.3 following the same.

Bottoming bath

18 Parts of 2-hydroxy-dibenzofuran-3-carboxylic acid-(2',5'-dimethoxy-phenyl-1')-amide are dissolved in 30 parts of ethanol, 54 parts of water of 50° C. and 12 parts of an aqueous 33% sodium hydroxide solution; the solution is introduced by stirring into a mixture of 63 parts of an aqueous 33% sodium hydroxide solution, 120 parts of sodium chloride and 24 parts of a fatty acid-protein degradation product-condensate in 6000 parts of water of 35° C.

Developing bath

58 Parts of a dyeing composition with a content of 20% by weight (referred to a molecular weight of 168) of 4-nitro-1-methoxy-benzene-2-diazonium-tetrachlorozincate (the residual part is essentially sodium sulfate as a diluent) are dissolved, together with 18 parts of monosodiumphosphate-dihydrate, 18 parts of pentasodium-tripolyphosphate and 2 parts of an octadecyl alcohol-polyglycolether, in 6000 parts of water of 20° C.

EXAMPLE 40

If instead of the dyeing composition mentioned in Example 39 there is used the equivalent amount of 4-chloro-1-methoxybenzene-2-diazonium-tetrachlorozincate, a dyeing is obtained which shows very similar properties.

EXAMPLE 41

If the process is carried out as has been described in Example 7, however, while using a developing bath which is obtained by dissolving 21 parts of 4'-methoxy-diphenylamine-4-diazonium chloride, 20 parts of succinic acid, 50 parts of sodium-tripolyphosphate and 2 parts of octadecyl alcohol-octadecyl-glycolether in 1000 parts of water, a blue dyeing is obtained which has very good fastness properties.

What is claimed is:

1. In a process for the preparation of dyeings by producing metal-free water-insoluble azo dyestuffs on the water according to the methods of the ice color dyeing, in which the fiber material is at first impregnated with a coupling component in an alkaline medium and the thus impregnated material is subsequently developed by treating it, with a developing bath which contains the diazonium compound, the improvement consisting in using a developing bath which contains an alkali metal-tri- or -tetrapolyphosphate, the pH value of the developing bath being greater than 4.5 prior to the coupling and smaller than 9 after the coupling process.

2. A process as claimed in claim 1, wherein the alkali metaltripolyphosphate is sodium-tripolyphosphate.

* * * * *